US005614296A

United States Patent [19]

Travelute et al.

[11] Patent Number: 5,614,296

[45] Date of Patent: Mar. 25, 1997

[54] RESILIENT MOLDED PREFORM MADE FROM STAPLE FIBERS OF SELF-TEXTURING FILAMENTS

[75] Inventors: Fred L. Travelute, Charlotte, N.C.; Robert E. Hoffman, Catawba, S.C.

[73] Assignee: Wellman, Inc., Shrewsbury, N.J.

[21] Appl. No.: 534,255

[22] Filed: Sep. 26, 1995

Related U.S. Application Data

[60] Division of Ser. No. 334,418, Nov. 4, 1994, Pat. No. 5,531,951, which is a continuation-in-part of Ser. No. 156, 237, Nov. 22, 1993, Pat. No. 5,407,625.

[51] Int. Cl.[6] ..... A47C 7/02; A47C 27/12; D04H 1/06; D04H 1/50

[52] U.S. Cl. ..... 428/212; 297/452.48; 428/338; 428/362; 428/398; 442/189; 442/360

[58] Field of Search ..... 428/224, 362, 428/212, 401, 338

[56] References Cited

U.S. PATENT DOCUMENTS

| | | |
|---|---|---|
| 3,050,821 | 8/1962 | Kilian . |
| 3,061,874 | 11/1962 | Lees . |
| 3,235,442 | 2/1966 | Stump . |
| 3,405,424 | 10/1968 | Imobersteg et al. . |
| 3,595,738 | 7/1971 | Clarke et al. . |
| 3,626,442 | 12/1971 | Haseley et al. . |
| 3,663,683 | 5/1972 | Czerkas et al. . |
| 4,035,879 | 7/1977 | Schippers . |
| 4,082,731 | 4/1978 | Knopka . |
| 4,301,102 | 11/1981 | Fernstrom et al. . |
| 4,343,860 | 8/1982 | Fernstrom et al. . |
| 4,546,043 | 10/1985 | Yoshimoto et al. . |
| 4,551,378 | 11/1985 | Carey, Jr. . |
| 4,562,029 | 12/1985 | Black . |
| 4,661,404 | 4/1987 | Black . |
| 4,743,504 | 5/1988 | Carr . |
| 4,803,036 | 2/1989 | Maruhashi et al. . |
| 5,069,843 | 12/1991 | Hansen . |
| 5,380,592 | 1/1995 | Tung . |

FOREIGN PATENT DOCUMENTS

| | | |
|---|---|---|
| 44-20497 | 9/1969 | Japan . |
| 63-282310 | 11/1988 | Japan . |
| 1583486 | 8/1990 | U.S.S.R. . |
| 1137028 | 12/1968 | United Kingdom . |
| 1137027 | 12/1968 | United Kingdom . |
| 1152647 | 5/1969 | United Kingdom . |
| 1175756 | 12/1969 | United Kingdom . |
| 2056362 | 3/1981 | United Kingdom . |

*Primary Examiner*—James C. Cannon
*Attorney, Agent, or Firm*—Bell, Seltzer, Park & Gibson, P.A.

[57] ABSTRACT

A method of producing self-texturing filaments that exhibit a desirable tendency to coil rather than to bend sharply or zig zag. The method includes directing a quenching fluid at extruded hollow filaments of a liquid polymer predominantly from one side of the hollow filaments to thereby produce hollow filaments with different orientations on each side. Thereafter the temperature of the hollow filaments is raised to a temperature sufficient for the filaments to relax, but less than the temperature at which the filaments would shrink. When the relaxed filaments are cut into staple lengths, they tend to assume a form that provides a favorable degree of mechanical entanglement that is useful in forming resilient solid structures.

4 Claims, No Drawings

RESILIENT MOLDED PREFORM MADE FROM STAPLE FIBERS OF SELF-TEXTURING FILAMENTS

This application is a divisional of application Ser. No. 08/334,418, filed Nov. 4, 1994, now U.S. Pat. No. 5,531, 951, which is a Continuation-in-Part of application Ser. No. 08/156,237, filed Nov. 22, 1993, now U.S. Pat. No. 5,407, 625.

FIELD OF THE INVENTION

The present invention relates to self-texturing filaments formed from synthetic polymer materials, and in particular relates to a self-texturing filament formed from polyester that exhibits a desirable tendency to coil rather than to bend sharply.

BACKGROUND OF THE INVENTION

Synthetic polymers are used in many textile applications to replace natural textile materials such as wool and cotton. Synthetic polymers are also used for other textile-related applications such as insulation layers in clothing, particularly clothing for outdoor use in colder weather, and for bulking properties in pillows and other such products in which these properties are alternatively provided by natural materials such as feathers or by synthetic foam materials.

The starting product for almost all synthetic textile materials is a liquid polymer that is extruded in the form of a thin filament of the material. Such filaments have some immediate uses such as fishing line. In textile applications, however, synthetic filaments and the fibers and yarns made from them should desirably provide properties similar to those of natural fibers such as wool or cotton. In order to provide such properties, synthetic filaments must be textured before being formed into yarns and fabrics. As is well understood in the textile industry, texturing can comprise crimping, looping, or otherwise modifying continuous filaments to increase their cover, resilience, abrasion resistance, warmth, insulation properties, and moisture absorption, or to provide a somewhat different surface texture.

Typical texturing methods include false twist texturing, mechanical texturing such as edge crimping or gear crimping, air jet crimping, knit-de-knit crimping, and the stuffer box method. In quite logical fashion, the resulting characteristics of the textured filament reflects the texturing method used. Thus, textured filaments can take the form of entangled filaments, multifilament coils, monofilament coils, stuffer box crinkles, knit-de-knit crinkles, or core-bulked filaments. Each of these has its own particular properties, advantages, and disadvantages.

Among these various types of textured filaments, coils are preferred for certain applications such as cushions and insulation. Coiled filaments tend to give more volume and fewer sharp bends, "zig-zags," or "knees." Generally speaking, coiled filaments, and the yarns made from them, take on a coil or spiral configuration that is somewhat more three dimensional than other textured filaments and thus are preferred for many bulking applications, including those mentioned above.

Typical methods for coiling filaments include false twisting or edge crimping, both of which techniques are well-known to those of ordinary skill in the art, and will not be otherwise further described herein.

Both of these methods have various advantages and disadvantages in producing coiled yarns. For example, false twist coiling requires a conventional false twist winding system, while an edge crimp method requires the mechanical devices necessary to physically produce the crimp.

Alternatively, coiled filaments can be formed from bilateral fibers that coil following further processing. Traditionally, bilateral fibers are formed from two different generic fibers or variants of the same generic fiber extruded in a side-by-side relationship. Although side-by-side or "bicomponent" spinning offers certain advantages, it also is a relatively demanding process that requires more complex spinning equipment and thus is advantageously avoided where unnecessary.

Therefore, it is an object of the present invention to provide a method of coiling filament, particularly polyester filament, to produce a coiled filament from which appropriate yarns or bulk material can be produced. Furthermore, it is an object of the invention to do so without the requirement of false twisting, mechanical crimping, or bicomponent spinning.

SUMMARY OF THE INVENTION

The invention is a method of producing self-texturing filaments that exhibit a desirable tendency to coil rather than to bend sharply, "knee" or zig-zag The method, comprises directing a quenching fluid at extruded hollow filaments of a liquid polymer predominantly from one side of the hollow filaments to thereby produce hollow filaments with different orientations on each side. Thereafter, the temperature of the hollow filaments is raised sufficiently for the filaments to relax, but less than the temperature at which the filaments would shrink, to thereby prevent the filaments from crimping. When these filaments are drawn and then permitted to relax, they coil favorably in a manner that would have otherwise required mechanical texturing.

In another aspect, the invention comprises a method of coiling bilateral hollow filaments in which the two component polymers are identical except for their degree of orientation. In yet another aspect, the invention comprises a coiled bilateral hollow polymeric filament in which the two component polymers are identical except for their degree of orientation.

In a further aspect, the invention comprises a method of cutting the resulting coiled filament prior to heat setting to produce cut, coiled filament that is particularly advantageous for bulk filling purposes.

The foregoing and other objects of the invention will be understood more clearly when taken in conjunction with the detailed description which follows.

DETAILED DESCRIPTION

The present invention is a method of producing self-texturing filaments that exhibit a desirable tendency to coil rather than to bend sharply, knee, or zig-zag. These shapes are hereinafter referred to as "crimps" or "crimping" as opposed to coils or coiling. The method comprises directing a quenching fluid at extruded hollow filaments of a liquid polymer predominantly from one side of the hollow filaments to thereby produce hollow filaments with different orientations on each side. Thereafter, the temperature of the hollow filaments is raised sufficiently for the filaments to relax while concurrently maintaining the filaments at a constant length to thereby prevent the filaments from shrinking and becoming brittle, both of which would inhibit drawability.

As used herein and in this art, orientation refers to the degree to which the chain molecules of a polymer are parallel to one another and to the longitudinal dimension of a filament. The degree of orientation can be measured using techniques well known in this art, particularly including birefringence.

In preferred embodiments, the liquid polymer comprises polyester which is extruded in the form of hollow filaments prior to the step of directing the quenching fluid at the hollow filaments. Further to the preferred embodiments, the step of extruding the hollow filaments comprises extruding two C-shaped filament sections and directing the sections to merge shortly after they are extruded to form the hollow filament. It will be understood by those familiar with the extrusion of filaments with various cross-sections that the phrase "C-shaped" is a general way of designating two shapes which when brought together would have a hollow space in between, including shapes that would very much resemble the letter "C." It will be further understood that the invention is not limited to C-shape extruded sections or to resulting circular cross-sections, but that these shapes represent descriptive embodiments of the invention.

The preferred quenching fluid is air. In the most preferred embodiments, the air is directed at the filaments as closely as possible to the point at which the hollow filaments are extruded. When, as in preferred embodiments, the step of extruding the filaments comprises extruding the filaments from a spinneret, then the step of directing a quenching fluid comprises directing the quenching fluid at the filaments within about four inches or less of the spinneret, and most preferably within about two inches of the spinneret head.

In preferred embodiments, the step of directing the quenching flow of air comprises directing the flow of air at a rate sufficient to quench the hollow filaments, but less than a rate that would blow the filaments into contact with one another before they were quenched into solid form.

If evaluated immediately following quenching, the hollow filaments can be considered as having a "cold side" and a "hot side," the cold side being the side at which quenching was originally directed, with the hot side being the generally opposite portion of the filament. As will be well understood by those of skill in this art, the cold side will at this point be generally more oriented that the hot side. It will be further understood that the terms "cold side" and "hot side" are used for explanatory purposes and not as limitations.

As is generally the case in filament spinning, the next step is referred to as "take-up" in which the extruded quenched filaments are collected on a series of rollers for further processing or packaging. The filaments solidify under the affects of lowered temperature during the take-up step.

According to the invention, the solidified filaments are then relaxed by heating them to a temperature greater than ambient and that is sufficient for them to relax, but less than the temperature at which they would shrink. Although the inventors do not wish to be bound by any particular theory, the term "relax" as used herein refers to a process in which the density or compactness of the molecular structure increases as a result of the heating process.

Generally speaking, an appropriate temperature range for relaxing polyester filaments is between about 40°–60° C. (104°–140° F.), depending on the extent of relaxation desired, as the intensity of the treatment effect is proportional to the temperature used. The higher temperatures to be avoided are those approaching the glass transition temperature ($T_g$) of polyester, approximately 68° C. (155° F.). In preferred embodiments of the invention, the relaxing step can be accomplished by heating the finishes applied to the filaments. As known to those familiar with this art, in more conventional spinning methods, such finishes are generally added at ambient temperatures.

Following the relaxation step, the hot side of the filament has very little orientation. The cold side has some orientation, but less than it had after the stretching that occurred during the initial take-up step.

In order to produce the desired coiling, the relaxed filament is next drawn in otherwise normal fashion, and then released. The draw temperature generally approaches the glass transition temperature. The drawing step adds stress to each side of the filament with the more oriented cold side being more stressed than the less oriented hot side. In preferred embodiments using polyester, the filaments are drawn to a stress level of about 0.3 to 0.4 grams per spun denier. In this regard, one of the apparent effects of the invention is that the relaxing step decreases overall orientation, but increases relative orientation. The relaxed structure is more dense, and can crystallize faster when heated above $T_g$ and drawn.

The drawn filaments are preferably cooled to room temperature, for example by cooling the draw rolls with circulating water. When the filament is released following drawing, both sides tend to return to their earlier condition ("recover"), but the cold side more so than the hot side, and the difference in the degree of recovery creates the desired coils. Preferably, the draw tension is released very suddenly, and as soon as possible after drawing. Similarly, because the relaxation forces are relatively moderate, interference with the filaments as they coil should preferably be avoided.

As a final step, the coiled filaments can be heat set, generally at temperatures of about 177° C. (350° F.) to produce a rigid coiled filament that is about 40% crystallized.

In another aspect, the invention comprises a method of coiling bilateral hollow filaments in which the two component polymers are identical except for their degree of orientation. As set forth in the background of the invention, bilateral filaments are usually those formed of two different polymers or two forms of a generic polymer. In the present invention, however, the two component polymers are identical and are only oriented differently as a result of the uneven quenching. The coiling method of the invention comprises raising the temperature of the hollow filaments to a temperature sufficient for the filaments to relax, but less than the temperature at which they would shrink. After a drawing step as described above, the filaments are released to coil in the absence of any control on their length.

In the preferred embodiments, the component polymers comprise polyester, specifically a single polyester, and the step of raising the temperature of the filaments sufficiently for the filaments to relax comprises raising their temperature to between about 40° C. and 60° C., depending upon the extent of relaxation desired.

Thus, in brief summary, the method steps of the invention can comprise extrusion, quenching, take-up, relaxation, drawing, release, and heat-setting.

In yet another embodiment, the invention comprises a coiled bilateral hollow polymeric filament in which the two component polymers are identical except for their degree of orientation. In preferred embodiments, the component polymers comprise polyester.

As stated earlier, the term "orientation" refers to the degree of parallelism of the chain molecules of a polymer. Although the inventors do not wish to be bound by any particular theory, the relaxation step of the present invention appears to permit both portions of the filament, which have different orientations resulting from the uneven quenching carried out upon them, to relax by the same amount of orientation while they maintain a consistent length (because they are fused).

For example, a hollow filament or fiber according to the present invention that has one portion with an orientation number of 10 and another portion with an orientation number of 5 has a 2:1 ratio of orientations and will texture accordingly. If that filament is then relaxed by four (4) units using the method of the present invention, the resulting filament has one portion reduced in orientation from 10 to 6, and a second portion reduced from 5 to 1. The resulting relaxed filament now has an orientation ratio of 6:1 rather than 2:1 and will exhibit correspondingly different texturing properties. It will thus be easily seen that the orientation ratio between the two portions of the same filament has essentially been tripled without any mechanical activity whatsoever.

Filaments formed according to the present invention, even though self-coiling and self-texturing, can also be mechanically or otherwise textured to give additional textured properties should such be desired or necessary. The invention is thus not limited to methods in which no mechanical or other texturing steps are carried out, but instead provides a method in which such other texturing methods can be minimized or eliminated if so desired, or included if so desired.

As an additional advantage of the invention, however, the capability to produce coil without mechanical crimping permits the production of thinner-walled, hollow, coiled filaments. Specifically, because the hollow filaments will coil without mechanical crimping, their walls can be thinner than the walls required to withstand mechanical crimping.

As a result, hollow filaments can be produced according to the present invention with as much as 25–35% void space (based on cross-section) compared to 15–18% void space for conventional, mechanically-crimped coiled hollow filaments. These more highly voided filaments give the same bulk properties as the less voided filaments, but at a significantly reduced weight. Stated differently, the invention provides a technique for obtaining high aspect ratio hollow filaments with lighter weight, but equivalent properties to more conventional hollow filaments.

EXAMPLE 1

An 80-pound sample of a spirally-coiled filament of 8 denier per filament (dpf) was produced on a 463-hole hollow pack using polyester. A quench cabinet was set to direct air at the filaments two inches below the spinneret at a 600 foot per minute peak air velecity. The takeup was set to standard conditions for 28/8 (spun denier/finished denier) hollow filament.

As part of the drawing process, a pre-bath and feed rolls were heated to 155° F. and the fiber was dram at a 3.8 draw ratio. The fiber was allowed to relax exit the draw nip roll where the crimp formed. The crimp tow accumulated at this point, was fed to a cutter, and then collected in bags. The cut fiber was taken to a dryer and heat set at 350° F. after which a soft hand finish was applied.

EXAMPLE 2

A 463-hole pack was again utilized in the manner described in Example 1. Polyester was spun at 900 meters per minute and 171 pounds per hour throughput to give 28 filaments. The same spacer length and quench profile as in Example 1 were again utilized.

For drawing, the pre-bath and feed rolls were heated to 155° F. and the draw ratio was set to 3.33. The water spray above the feed rolls was used at a relatively low flow rate and the draw rolls were cooled to ambient temperature with circulating water, and a draw nip roll was installed.

The drawn tow was taken through the dancer rolls and into the crimper with the pre-crimper steam chest off. The crimper flapper was up and the crimper nip roll pressure was reduced to 30 psi from 80 psi. The crimp formed exit the crimper nip and the crimped tow was guided onto the conveyer to the dryer. After passing through the dryer at 350° F., soft hand finish was applied and the fiber was cut on the production cutter.

Several hundred pounds of coiled filament were produced in accordance with Example 2. The material was evaluated by garnetting to form standard and queen size pillows. In spite of the soft hand finish, the material processed well and demonstrated excellent fill power. Queen pillows which normally require between 25 and 26 ounces of fill required only 22 ounces of the material according to the present invention to maintain the normal pillow size. Similarly, a test with standard pillows indicated that 16 ounces of the material of the present invention was adequate in a pillow that normally required 20 ounces of filler.

Further to the present invention, it has now been determined that if the relaxed coiled filaments are cut into staple length before being heat set, they form an unusual and useful staple filament. In this aspect of the invention, the individual stapled have the overall helical coil, and of which the ends curl to even a greater degree in a manner that might be analogously described as a "fish hook" effect. Althoguh the inventors don't wish to be bound by any particular theory, it appears that these fish hook-like curls on the ends of the helixes are the lowest potential energy form for the relaxed filaments once they have been cut into staple lengths. By way of comparison, it will be understood that continuous tow formed in conventional fashion—i.e., not according to the method of the present invention—does not exhibit such additional curling, apparently because there exists little or no potential energy driving force to encourage them into such an orientation.

The combination of both the overall helical structure of the staple filaments and their more aggressively curled ends offers the opportunity for greatly enhanced mechanical entanglement when the staple filaments are pressed together in an appropriate fashion. In general, it appears that the helixes of the cut staple filament pieces wrap around one another, while the curled ends add an even greater degree of entanglement.

Furthermore, it has been unexpectedly discovered, according to the present invention, that the entanglement potential provided by cutting—and particularly cutting prior to any heat setting—offers a degree of mechanical stability that can totally eliminate binder fibers or binder resins in nonwoven applications such as carding, batting, cross-lapping and others. Such applications can also include domestic and automotive furniture cushions, among others. It will be understood, however, that such applications are exemplary, and not otherwise limiting of the present invention.

In this regard, and as well known by those of ordinary skill in this art, one traditional method of keeping staple fibers together (other than spinning, weaving, or knitting) to form a solid mass for applications such as cushions, is to add a small amount of some binder fiber or binder resin. Typically, the binder fiber melts at a lower temperature than the structural fiber so that a heat-setting treatment can be used to hold the majority of the structural fibers together. Alternatively, the term "binder resins" often refers to a liquid applied to the structural fibers that later cures and holds the structural fibers together.

Binder fibers and resins raise certain disadvantages, however, particularly the disadvantage of being formed of a different polymer resin. Accordingly, items formed of polyesters plus additional resins cannot be recycled in the same manner as can products that are formed of polyester alone. In general, the presence of the added polymer resin requires additional recycling steps.

The ability to form coherent solid masses with mechanical integrity entirely out of polyester and without binder fibers or resins offers additional advantages beyond more efficient recycling. In this regard, binder fibers also cause problems when heat stress is applied to the mass that they are intended to hold together. Thus, many formed polymer objects fail various heat test requirements because of their binder fibers, rather than because of their structural fibers. Thus, by eliminating the binder fiber, the thermal characteristics of molded objects made according to the present invention are favorably those of the polyester alone.

For example, in ASTM Test D3574 part D1, resilient materials such as polymer foams or fiber batts are compressed to 50% of their original height and held in the compressed state at 70° C. for 22 hours. The permanent height loss of the sample is then measured. By way of comparison, polyurethane foam, which is often used as a furniture cushioning material, loses only 6% or 7% of its height in this test, while ordinary polyester batting will lose between 30% and 35%. In the present invention, however, when the relaxed filaments are cut, formed into a preform, and then heat-treated, they are expected to exhibit a favorable loss of height in the ASTM D3574 test.

In brief summary, this aspect of the invention comprises cutting the released coiled filaments into staple lengths, and thereafter heat-setting the cut staple filaments. If desired, the cut filaments can be molded or otherwise formed into a desired shape before or after heatsetting to produce the preformed shapes very often desired by furniture manufacturers and other similar applications.

A typical heat-set temperature is about 175° C. (350° F.), which represents the point of maximum crystallization for most polyesters, and thus the most stable product, but can be selected to range from between about 70° C. to about 200° C. This range represents minimal change through the degradation temperature.

The length to which the staple is cut is a parameter that can be adjusted according to various needs. As expected, cutting the staple shorter produces a greater number of ends and thus "fish hooks," but a lesser degree of helical entanglement. Alternatively, cutting the staples at longer lengths produces fewer curled ends, but a greater degree of entanglement between the longer entangled helixes. Thus, the cut length can be adjusted for various end uses as may be most appropriate or desired.

Because seating cushions, particularly automobile seating cushions, often require a relatively high degree of resiliency, the deniers are generally selected to be larger; i.e., bigger and stiffer fibers with higher bending modulus. Lower denier filaments will, of course, produce generally softer products. By way of comparison, in aspects of the invention other than molded resilient products, the denier may be on the order of about 6, while for automobile seating and other furniture applications, the denier is generally selected to be between about 15 and 20. It will thus be understood that the denier can be selected in accordance with the desired end use, and that the described deniers are illustrative of the invention, rather than limiting.

In summary, this aspect of the invention provides a greater degree of loft than regular crimped fibers, a greater filling power, and eliminates binder fibers or binder resins that raise costs, create heat problems, and complicate one or more of the processing or recycling steps.

In the specification, typical preferred embodiments of the invention had been disclosed and, although specific terms have been employed, they have been used in the generic and descriptive sense only and not for purposes of limitation, the scope of the invention being set forth in the following claims.

That which is claimed is:

1. A resilient molded preform formed entirely of polyester, said preform comprising a plurality of coiled bilateral hollow polymeric fibers, said fibers having staple lengths and together forming a predetermined overall shaped solid, and in which the two bilateral components are an identical polyester but with each component having a different degree of orientation, and in which said staple fibers are sufficiently entangled with one another to eliminate the need for any binder filaments or binder resins.

2. A preform according to claim 1, wherein said staple fibers have an overall helical coil, with ends of said staple fibers having a greater degree of curl than central portions of said fibers, to thereby form a fish hook effect at the fiber ends.

3. A preform according to claim 1, wherein said fibers are about 15–20 denier in size.

4. A preform according to claim 1, wherein said fibers have a void space comprising approximately 25–35% of a total cross-sectional area of the fiber.

* * * * *

UNITED STATES PATENT AND TRADEMARK OFFICE

CERTIFICATE OF CORRECTION

PATENT NO. : 5,614,296

DATED : March 25, 1997

INVENTOR(S) : Travelute, et al.

It is certified that error appears in the above-indentified patent and that said Letters Patent is hereby corrected as shown below:

Col. 2, line 27, after "zig-zag", add --.--;

Col. 5, line 52, "velecity" should be --velocity--;

Col. 5, line 56, "dram" should be --drawn--;

Col. 5, line 67, after "28", insert --denier--;

Col. 6, line 31, "stapled" should be --staples--;

Col. 6, line 33, "Althoguh" should be --Although--; and

Col. 7, line 25, "D1," should be --D--.

Signed and Sealed this

Fifth Day of August, 1997

Bruce Lehman

*Attest:*

BRUCE LEHMAN

*Attesting Officer*

*Commissioner of Patents and Trademarks*